US006735151B2

(12) United States Patent
Triponez

(10) Patent No.: US 6,735,151 B2
(45) Date of Patent: May 11, 2004

(54) ELECTRONIC WATCH WITH A LARGE DATE APERTURE

(75) Inventor: André Triponez, Lamboing (CH)

(73) Assignee: Eta SA Fabriques d'Ebauches, Grenchen (CH)

( * ) Notice: Subject to any disclaimer, the term of this patent is extended or adjusted under 35 U.S.C. 154(b) by 264 days.

(21) Appl. No.: 09/928,484

(22) Filed: Aug. 14, 2001

(65) Prior Publication Data

US 2002/0024887 A1 Feb. 28, 2002

(30) Foreign Application Priority Data

Aug. 23, 2000 (CH) ..... 1637/00

(51) Int. Cl.[7] ..... G04B 19/24; G04B 19/20
(52) U.S. Cl. ..... 368/28; 368/35; 368/37
(58) Field of Search ..... 368/28, 35, 37, 368/223, 228

(56) References Cited

U.S. PATENT DOCUMENTS 4,257,113 A * 3/1981 Meister et al. ..... 368/35
4,257,115 A * 3/1981 Hatuse et al. ..... 368/69
5,299,177 A 3/1994 Koch
5,469,410 A * 11/1995 Berney ..... 368/28

FOREIGN PATENT DOCUMENTS

| | | | |
|---|---|---|---|
| CH | 190208 | A | 4/1937 |
| CH | 316461 | | 11/1956 |
| CH | 686106 | A | 1/1996 |
| CH | 688671 | A | 1/1998 |
| EP | 0 383 541 | A | 8/1990 |
| EP | 0 617 346 | A | 9/1994 |
| FR | 1 186 707 | A | 8/1959 |
| WO | WO 94/03845 | A | 2/1994 |

* cited by examiner

*Primary Examiner*—Vit W. Miska
(74) *Attorney, Agent, or Firm*—Griffith & Szipl, PC

(57) ABSTRACT

The electronic watch includes hands (2, 4, 5) indicating the time, a device (6) displaying at least the date, this device being formed of first (9) and second (10) indicators on which are marked figures (11, 12) respectively indicating the tens and the units of said date. A control member able to be activated manually allows the hands to be set to the correct time and the date to be set. The first (9) and second (10) indicators are each driven by an independent motor (17, 18).

18 Claims, 5 Drawing Sheets

ELECTRONIC WATCH WITH A LARGE DATE APERTURE

FIELD OF THE INVENTION

The present invention relates to an electronic watch powered by an electric power source and including hands indicating the time rotating above a dial, a device displaying at least the date, this device being formed of first and second indicators on which are marked figures respectively indicating the tens and the units of said date, the date appearing through a large aperture made in the dial, and a control member able to be activated manually to allow the hands to be set to the correct time and the date to be set.

BACKGROUND OF THE INVENTION

In most cases watches displaying the date are provided with a single disc or ring at the periphery of which figures from 0 to 31 are marked these figures appearing through an aperture made in the watch dial. By their very nature, date indications are thus of small dimensions and relatively difficult to read. In order to improve this situation and propose a date of large dimensions which is easy to read, there are available on the market watches provided with a so-called large date aperture through which appear a first indicator on which the figures of the tens of the date are marked and a second indicator on which the figures of the units of said date are marked.

The document CH 688,671 discloses such a large date aperture. In this document, the date display mechanism includes a tens indicator disc with four positions and a units indicator disc with ten positions. The mechanism includes a drive wheel completing one revolution per month and including two distinct irregular toothings. The first toothing includes thirty teeth for incrementing the tens indicator disc. The teeth of the first toothing are spaced by one 31st of a revolution so that one tooth is missing to form a complete circular toothing and that the incrementation of the units disc misses thus one step out of thirty one. The drive wheel is positioned angularly such that the 1 is the figure whose display is kept longest, the teeth of the second toothing being disposed such that the tens indicator disc is incremented, on the one hand, each time that the units indicator disc passes from 9 to 0 and, on the other hand, at the moment when the missing tooth would have activated the units indicator if it existed.

The complexity involved in mechanically driving the two date indicators from a drive wheel is evident from the foregoing description, and the complexity of the mechanism for setting the date described will not be described here.

SUMMARY OF THE INVENTION

When one has an electronic watch as is the case of the present invention, the above encountered difficulties are avoided by implementing the essential peculiarities of the present invention which consist in driving each of the first and second indicators forming the date by an independent motor.

By taking advantage of the presence of the aforementioned motors, the present invention also proposes displaying, by means of the same first and second indicators, the number of the month and the two last figures of the year, the date thus being able to be a perpetual calendar.

BRIEF DESCRIPTION OF THE DRAWINGS

The features and advantages of the invention will become clear now from the following description, made with reference to the annexed drawing and providing, by way of non limiting explanatory example, an advantageous embodiment of the invention, drawing in which.

DETAILED DESCRIPTION OF ILLUSTRATIVE EMBODIMENTS

Figure 1:
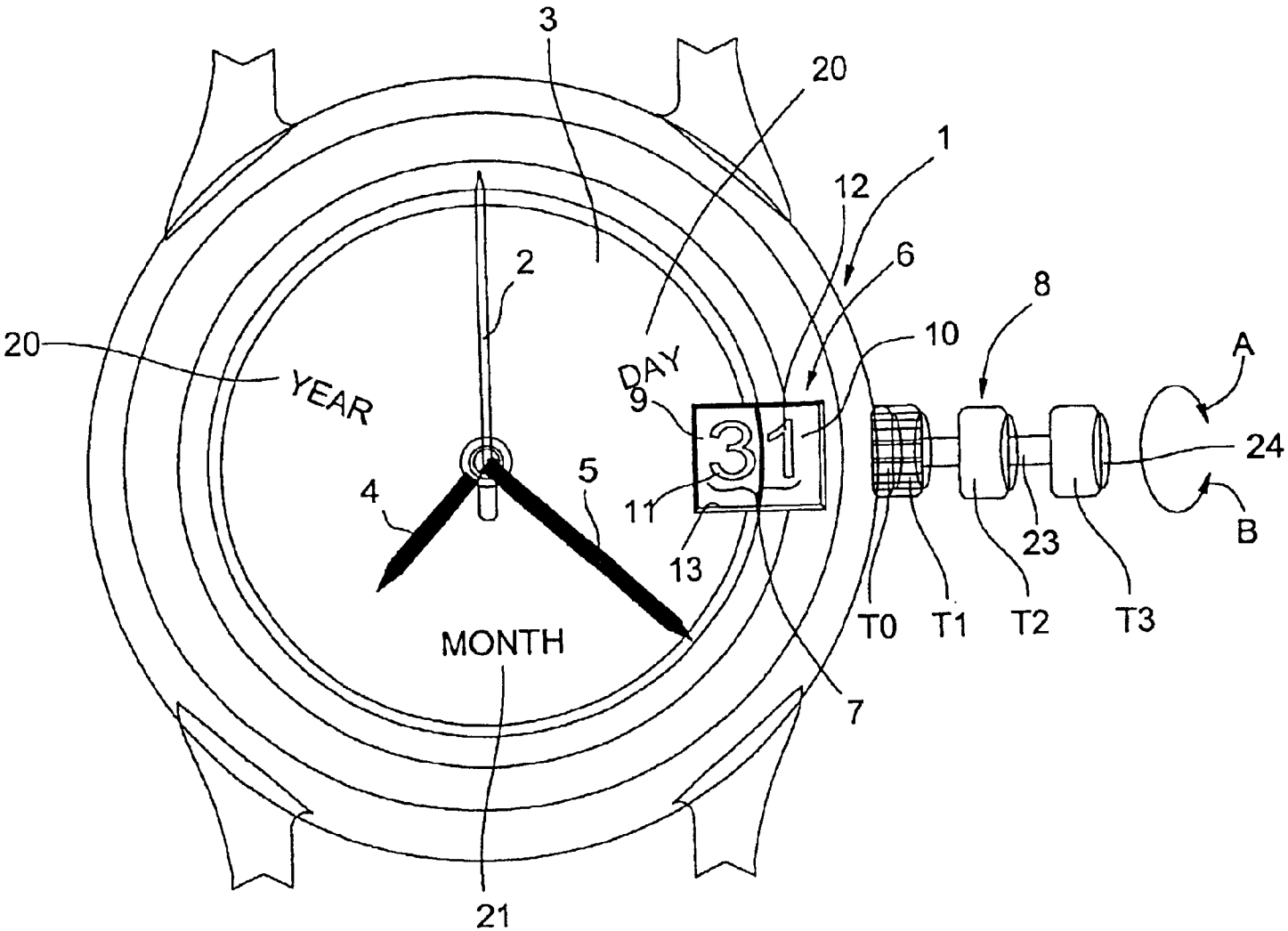
FIG. 1 is a plan view of the watch according to the invention.

As shown in FIG. 1, watch 1 according to the invention includes hands indicating the time 2, 4 and 5 rotating above a dial 3. A second hand 2, minute hand 5 and hour hand 4 are shown here. It is clear however, that second hand 2 could be omitted as will be seen below. The watch also includes a device 6 displaying at least the date. This device is formed of first 9 and second 10 indicators (which appear more clearly in FIG. 2) on which are marked figures 11 and 12 indicating respectively the tens and units of said date. As FIG. 1 shows, the date appears through a large aperture 13 made in dial 3. Watch 1 also includes a control member 8 formed here of a stem 23 capped by a crown 24 but which could be of another type. Control member 8 allows the hands to be set to the correct time and the date to be set.

Figure 2:
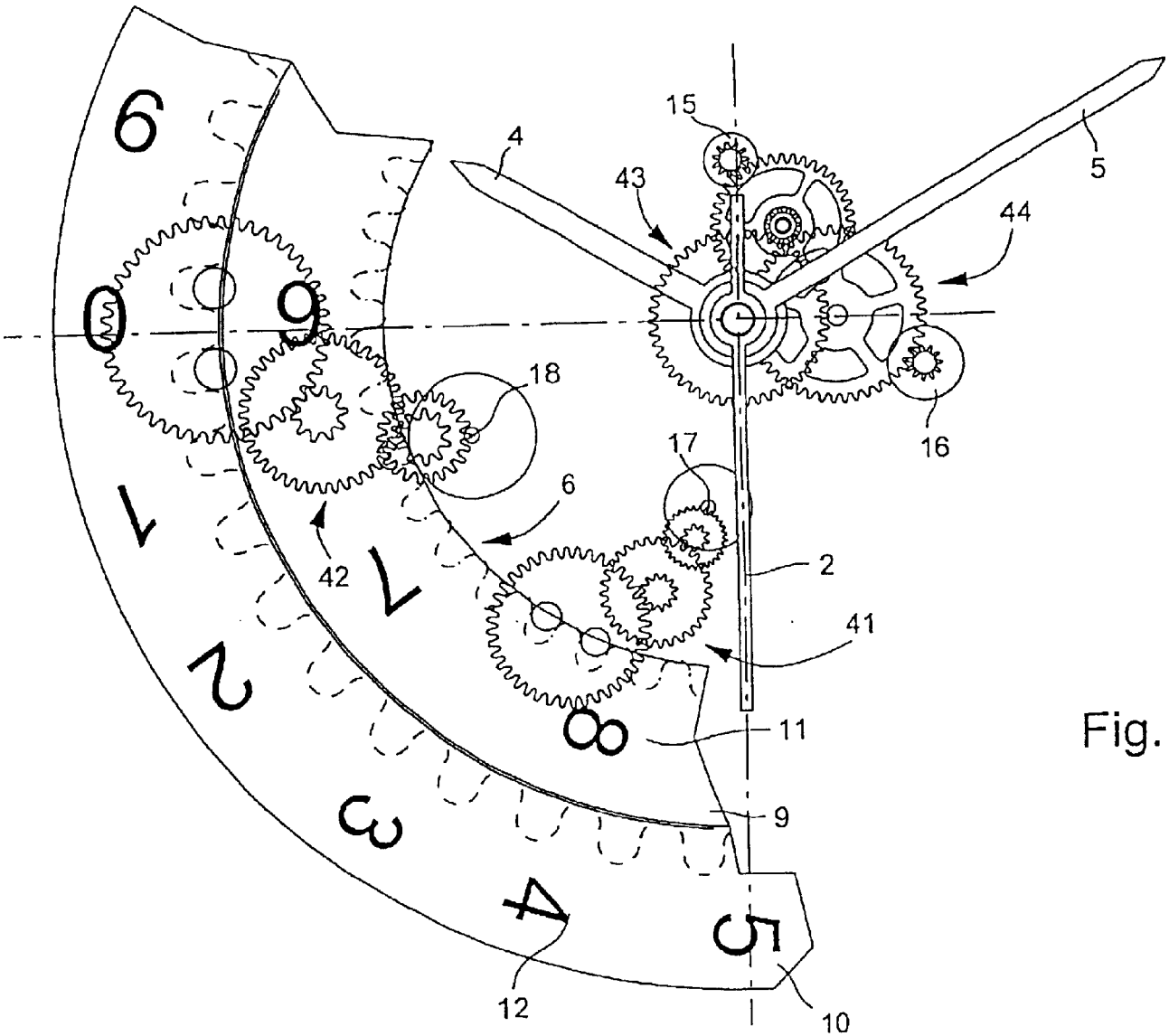
FIG. 2 is a plan view of the drive mechanism for the hands and the date indicators of the watch of FIG. 1.

The present invention is characterised in that the first 9 and second 10 indicators are each driven by an independent motor as is seen in FIG. 2 where first indicator 9 is driven by motor 17 and second indicator 10 is driven by motor 18. FIG. 2 shows that a kinematic chain 41 separates motor 17 from first indicator 9 and a kinematic chain 42 separates motor 18 from second indicator 10. Without it being necessary to describe this in detail here, it will be understood that the passage from one day to another increments second indicator 10 by one step, while first indicator 9 is incremented by one step when second indicator 10 passes from the figure 9 to the figure 0, this first indicator 9 of course only including the repetition of the figures from 0 to 3, unlike the illustration of FIG. 2, this Figure being used above all to explain a more evolved embodiment of the invention which will be explained in more detail below.

Thus in its simplest form, the first and second indicators forming the date are each controlled by an independent motor, this advantageously replacing the complicated drive and hand setting mechanisms of said date, such mechanisms being mentioned above with respect to the prior art. In this simple case, the control member will be used to correct the date at the end of months including less than thirty one days.

Figure 4:
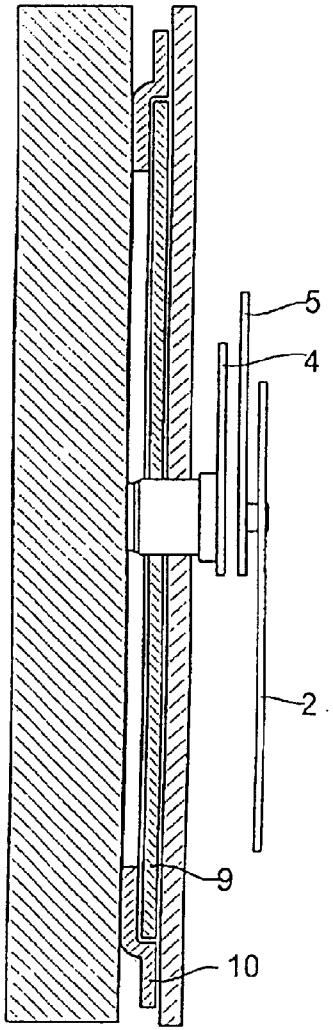
FIG. 4 is a cross-section through FIG. 1.
Figure 3:
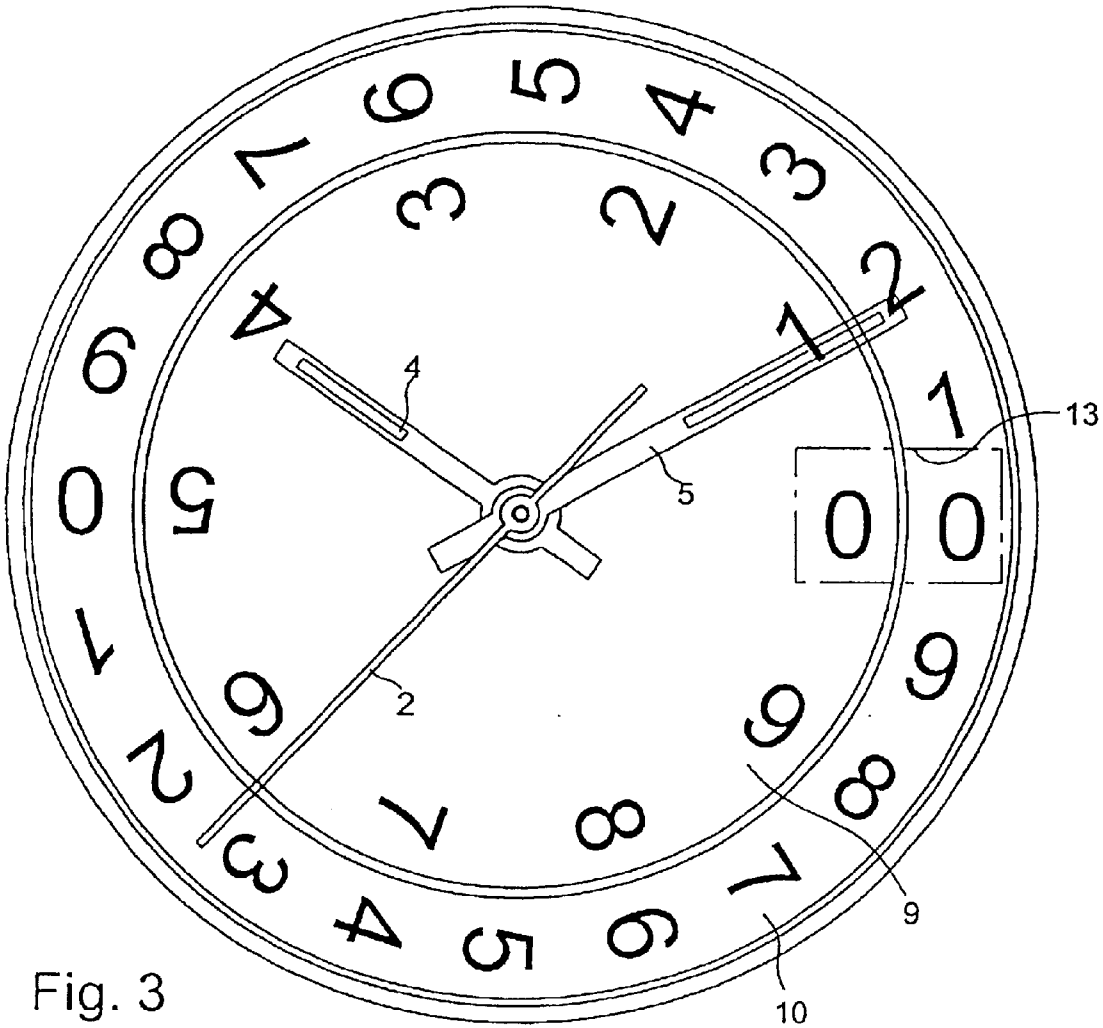
FIG. 3 is a plan view of an embodiment of the date indicators fitted to the watch of FIG. 1.

The first and second indicators 9 and 10 may be formed of two concentric discs as shown in FIGS. 3 and 4. The date appears through aperture 13. It will be understood that the aperture can only be arranged at 3 o'clock or 9 o'clock. Another embodiment which is not shown consists in proposing two concentric superposed rings as described for example in document CH 316,461. This other embodiment allow the date to be displayed at midday or 6 o'clock.

A more complete embodiment of the invention will now be described, embodiment shown in the Figures accompanying this description. This more complete embodiment further exploits the fact that the first and second indicators are driven by independent motors. In fact this new situation not only allows said indicators to be driven very simply, as already mentioned, but also allows advantage to be taken of the presence of said motors to display data other than just the date by means of said indicators.

Thus as is seen in FIGS. 1 and 2, watch 1 includes a second hand 2 driven via a kinematic chain 43, by a first motor 15, and hour hand 4 and minute hand 5 driven, via another kinematic chain 44, by a second motor 16. The first and second indicators 9 and 10 are respectively driven, via kinematic chains 41 and 42, by third and fourth motors 17 and 18. In this embodiment, and in response to first, second and third activations of control member 8, the first and second indicators 9 and 10 are able to display current data relating to the date, i.e. successively and respectively the perpetual calendar, the number of the month and the last two figures of the year. It will be recalled here that "perpetual calendar" means a calendar which is moved forward, without any manual intervention by the person wearing the watch, by one day at the end of the months of thirty one days, by two days at the end of months of thirty days, by three days at the end of the month of February in a leap years and by four days at the end of the month of February in non leap years.

In order to implement the foregoing the watch is organised according to the block diagram of FIG. 5, which is a simplified electric diagram of the various circuits contained in the watch and which will now be explained.

The watch includes an electric power source 25 which, in the watch taken by example here, is a battery. One could however propose other power sources, for example a solar cell or a generator controlled by an oscillating weight, the battery chosen here thus in no way constituting a limitation of the invention.

The watch also includes a quartz time base 45 followed by a frequency divider 46 which controls a unit 26 the purpose of which is to control the time and data of the calendar. In order to do this, this unit 26 has day, month and year counters arranged to supply a perpetual calendar extending at least over the century which began in the year 2001. The manner in which unit 26 is organised will not be described here in detail since it is known and explained in numerous documents for example in the disclosures of inventions CH 686 106 (EP-B-0 617 346) and EP-A-0 247 418. FIG. 5 also shows that unit 26 is controlled by a control unit 47 for the inputs of control member 8, i.e. the position of this member T0 to T3 as well as its rotational direction A or B, this unit 47 also being described in the first document which has just been cited. The signals necessary to activate usual drivers 48 to 51 are found at the output of unit 26, said drivers in turn controlling the four motors 15 to 18 of the watch i.e. in the order of FIG. 5, driver 48 activating motor 16 which drives the minute and hour hands 5 and 4, driver 49 activating motor 15 which controls second hand 2, driver 50 activating motor 17 which drives first indicator 9 of the tens and driver 51 activating motor 18 which drives second indicator 10 of the units. As FIG. 5 shows, divider 46, units 26 and 47 and drivers 48 to 51 form part of a single integrated circuit referenced 52 here.

It was seen above that the data relating to the calendar, namely the date, the month and the year appear successively through aperture 13 following successive activations of control member 8. One also needs to know and indicate which of the data listed above is displayed in the aperture. Such knowledge or designation of the display is conferred here on second hand 2 which momentarily loses its first function to indicate on dial 3 which is the data which appears in the aperture. For this purpose, a first activation of control member 8 positions second hand 2 on a first marking 20 (day) indicating that first and second indicators 9 and 10 are displaying the date. A second activation of control member 8 positions second hand 2 on a second marking 21 (month) indicating that first and second indicators 9 and 10 are displaying the number of the month. Finally, a third activation of control member 8 positions second hand 2 on a third marking 22 (year) indicating that first and second indicators 9 and 10 are displaying the last two figures of the year. It will be noted that using a same hand for different purposes is-already known in the state of the art. Reference will be made for this purpose to document CH 686 106 cited above wherein a second hand is also used to display the date.

It will be noted that designating the data appearing in the aperture may be achieved other than by means of second hand 2. One may imagine that the watch has only hour and minute hands each driven by an independent motor and that at the moment that control member 8 is activated, these two hands are superposed to point to one of the indications described above and carried on dial 3. Such a method is known from document EP-B-0 589 353 (U.S. Pat. No. 5,299,177) wherein the hour and minute hands are used together to indicate for example whether an alarm signal will be set off or not when an alarm time is reached. Thus, in conclusion to the foregoing, the watch of the invention generally includes at least two hands respectively driven by first and second motors 15 and 16.

Referring once again to FIG. 1, it can be seen that control member 8 includes in the watch taken by way of example, a stem 23 capped by a crown 24. The crown may be rotated in a first direction A or a second direction B. Most of the time this crown occupies a stable neutral position T1 for which the watch is in normal mode where it displays the second, the minute, the hour and the date. From this stable position T1, the crown may be pushed in into a position T0 which remains pushed in as long as manual pressure is exerted on crown 24. The crown thus acts as a pushbutton which returns to stable neutral position T1 when the pressure is released. Finally crown 24 may be brought, from the first stable neutral position T1 to a second stable pulled out position T2, then a third stable pulled out position T3.

The various ways in which crown 24 can be manipulated on the one hand to set the time and the date and on the other hand to initialise the time and the date will now be described.

Setting the Time

Setting the time of minute hand 5 and hour hand 4 is achieved by pulling out crown 24 into the third position T3 (see FIG. 1) then rotating said crown in a direction A or in the other direction B. If the crown is rotated slowly, minute hand 5 is moved forwards or backwards depending on the direction of rotation of the crown. If the crown is rotated quickly, the hour and minute hands are moved forwards or backwards by an hour depending on the rotational direction of the crown. In order to adjust second hand 2, stem 23 is pulled out into position T3 at the moment when the hand passes at midday then the hour and minute hands are set after which the stem is pushed in back into position T1 at the sound of the time signal. These manipulations are not new since they are well known from numerous watches on the market.

Setting the calendar

In order to set the calendar, reference will be made to FIG. 1, and especially to FIG. 6 which is a flow chart explaining the various functions of crown 24.

From neutral position T1, a first short pressure T0 is exerted on crown 24, this pressure being exerted for a duration which is less than a determined time, chosen here to be 4 seconds, i.e. p<4. The first and second indicators 9 and 10 are then brought to display the date referenced 30 in FIG. 6. The crown is then pulled out into its second position T2. Setting the date, referenced 31, is achieved by rotating crown 24 in a direction A to set first indicator 9 and in the other direction B to set second indicator 10. Once this is done, a second short pressure T0 is exerted on crown 24, which causes first and second indicators 9 and 10 to display the number of the month (from 1 to 12) referenced 32 in FIG. 6. Crown 24 is then pulled out into its second position T2. Setting the number of the month, referenced 33, is achieved by rotating crown 24 in a direction A to set first indicator 9 (the tens indicator) and in the other direction B to set second indicator 10 (the units indicator). Once this is done, a third short pressure T0 is exerted on crown 24, which causes first and second indicators 9 and 10 to display the last two figures of the year (01 to 99) referenced 34 in FIG. 6. Crown 24 is then pulled out into its second position T2. Setting the year, referenced 35, is achieved by rotating crown 24 in a direction A to set first indicator 10 (the units indicator). Once this is done, a fourth short pressure T0 is exerted on crown 24 which brings first and second indicators 9 and 10 into normal mode S where they display the date.

Figure 6:
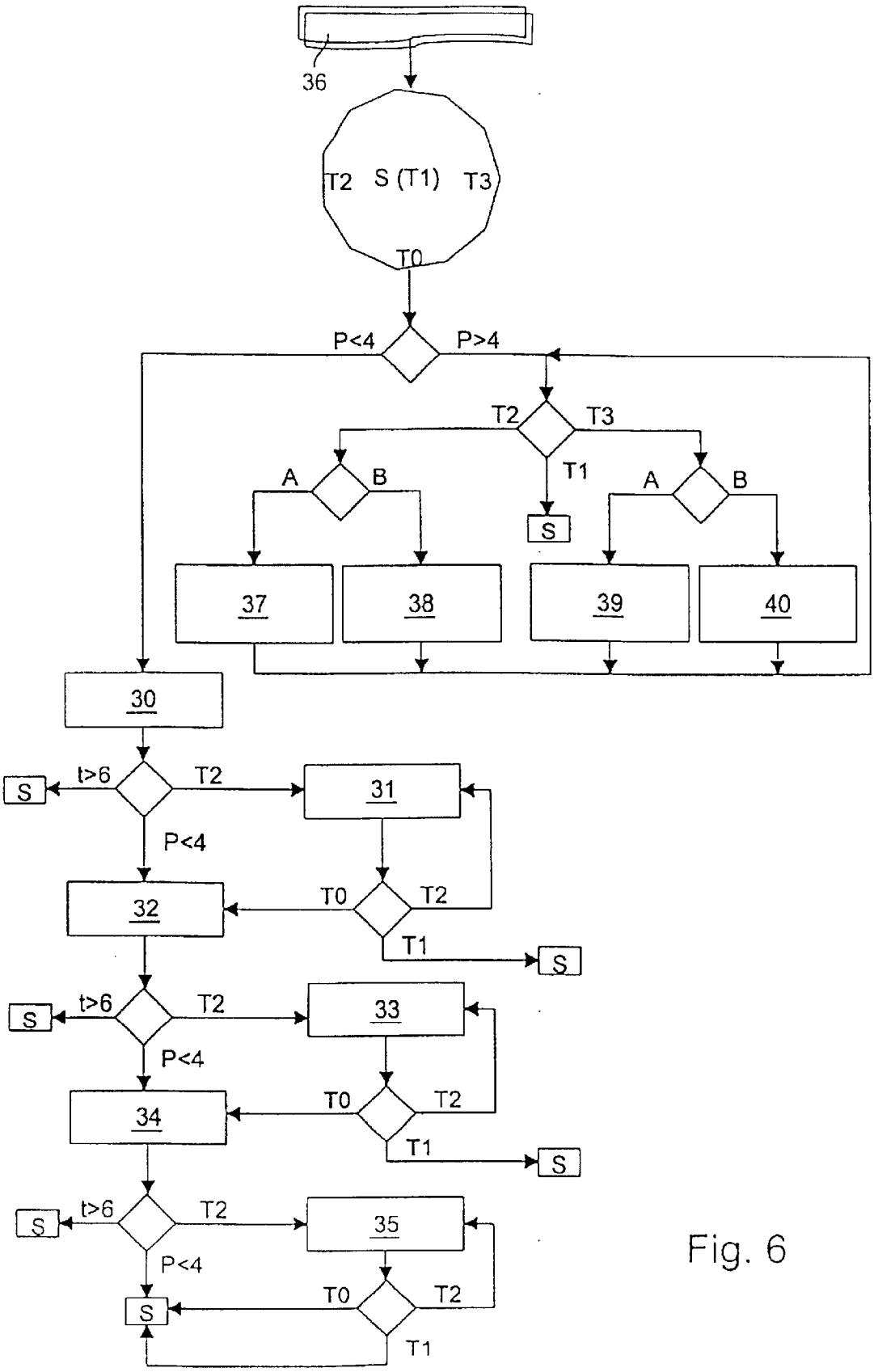
FIG. 6 is a flow chart explaining certain functions of the control member of the watch shown in FIG. 1.

FIG. 6 also shows that after each setting 31, 33 or 35 one can return to normal mode S by setting the crown 24 in position T1.

Calendar Display

FIG. 6 also shows that one can pass directly from one display (for example date 30) to another (for example month 32) without having to pass through adjustment of such data. In order to do this, after having displayed date 30 for example, a short pressure T0 is exerted on the crown to display the month 32.

It goes without saying that the display of the various calendar data is accompanied by the indication of the nature of such display, by second hand 2, for example, as was explained hereinbefore, this hand 2 returning to its second indicating function when one returns to normal mode S.

FIG. 6 also shows finally that after any of displays 30, 32 or 34, the watch returns to normal mode S after a certain determined period of time which is fixed here at 6 seconds (referenced t>6). It will be noted that this peculiarity could be omitted.

Initialisation

Figure 5:
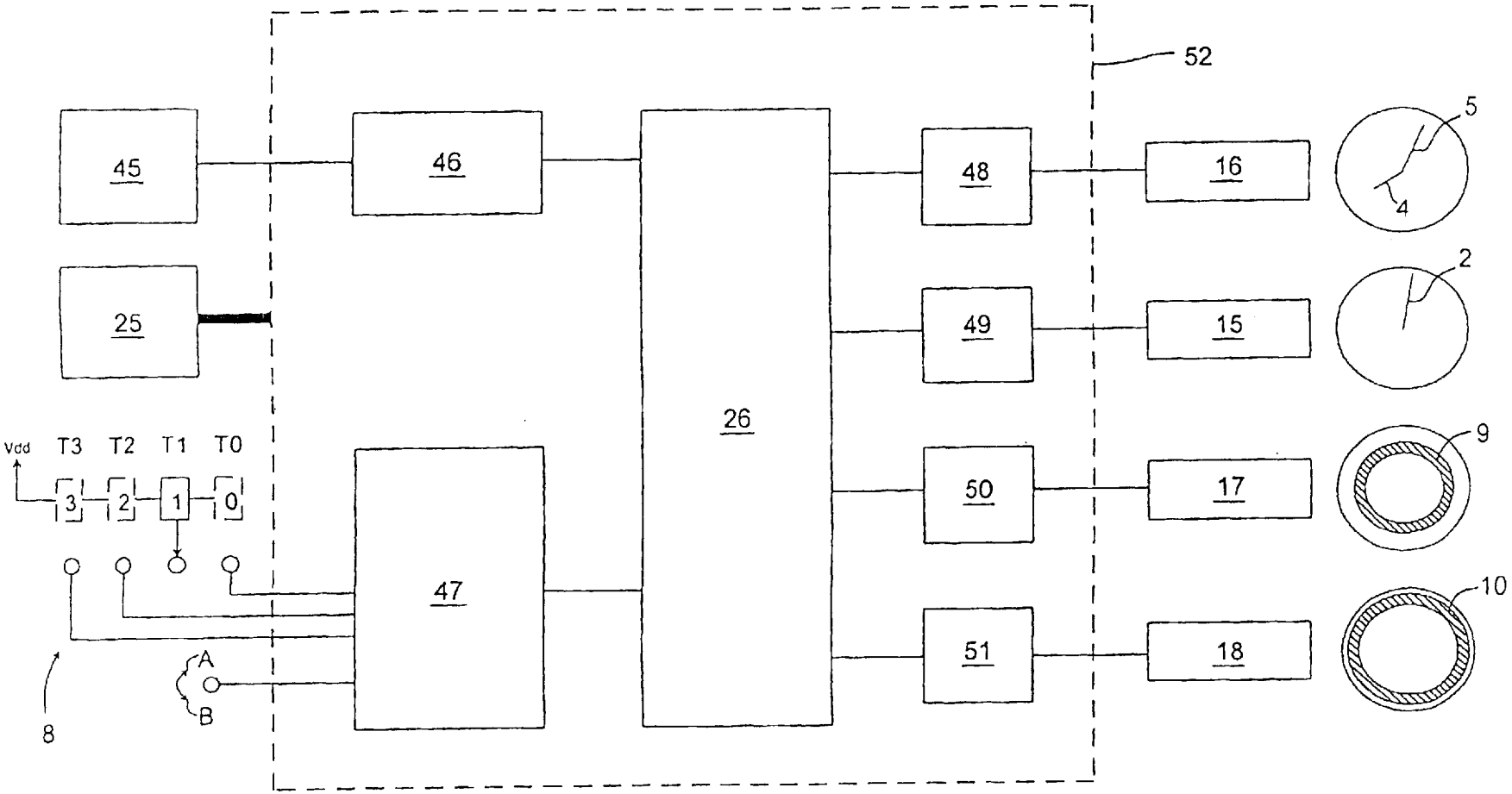
FIG. 5 is a general electric diagram of the watch according to the invention.

It was already stated above with reference to FIG. 5 that the watch includes an integrated circuit 52 essentially formed of counters 26 for the date, the number of the month and the last two figures of the year. Since, for reasons of economy, one does not wish to fit the watch with special memories keeping the content of the counters when, for example, supply battery 25 has to be changed—these memories occupy space and are expensive—it is clear that it is necessary, when a new battery is set in place, to make the value of counters 26 contained in integrated circuit 52 correspond with the values displayed by the three hands and the two indicators. This operation is called initialisation. For this purpose, the integrated circuit is arranged so that its counters are automatically reset to zero when a new battery 25 is set in place. It is thus then necessary to set second hand 2, minute hand 5 and hour hand 4 to midday, and to set first and second indicators 9 and 10 to zero, via appropriate manipulations on crown 24. These initialisation operations will be explained now.

Time Initialisation

In order to initialise the second, minute and hour hands of the watch taken as an example here, crown 24 is pulled out (see FIG. 1) into the second position T2. Second hand 2 can then be initialised at midday when crown 24 is rotated in a first direction A and minute hand 5 and hour hand 4 can be initialised at midday when the crown is rotated in a second direction B. Once the hands have been set at midday, the crown can be pulled out directly into position T3 in order to set the time in a similar way to that described hereinabove.

Calendar Initialisation

In order to explain the following manipulations, reference will be made to FIG. 6. Here changing battery 25 bears the reference 36.

From neutral position T1 a long pressure is exerted on crown 24, this pressure being exerted for a period of time greater than a determined time, which is chosen here to be 4 seconds, i.e. p>4. Crown 24 is then pulled out into its second position T2 then first indicator 9 is initialised to zero by rotation crown 24 in first direction A (operation referenced 37) following which second indicator 10 is initialised to zero by rotating crown 24 in second direction B (operation referenced 38). After resetting indicators 9 and 10 to zero, a short pressure T0 (p>4) is exerted on crown 24 and the different values of the calendar are adjusted as explained hereinbefore.

After the above described initialisation, it may happen that the figures are not perfectly aligned one next to the other. In order to correct this imperfection, the watch of the invention is provided with a fine initialisation system. In order to do this and after having exerted a long pressure T0 (p>4) on the crown, the latter is pulled out into position T3. First indicator 9 is finely initialised by rotating crown 24 in first direction A (operation referenced 39) following which second indicator 10 is finely initialised by rotating crown 24 in second direction B (operation referenced 40).

What is claimed is:

1. An electronic watch powered by an electric power source and comprising:

hands indicating the time rotating above a dials;

a device displaying at least the date, this device being formed of first and second indicators on which are marked figures respectively indicating the tens and the units of the date, the date appearing through a large aperture made in the dial;

a control member able to be activated manually to allow the hands to be set to the correct time and the date to be set, the first and second indicators being each driven by an independent motor; and at least two hands driven respectively by first and second motors, wherein the first and second indicators are driven respectively by third and fourth motors, the first and second indicators are able to display, in response to first, second and third activations of the control member, current data relating to the calendar, respectively and successively, the date, the number of the month and the last two figures of the year, and the watch is organised to cause the date to move forwards by one day at the end of months of thirty-one days by two days at the end of months of thirty days, by three days at the end of the month of February in a leap year and by four days at the end of the month of February in a non-leap, year.

2. A watch according to claim 1, including a second hand driven by the first motor and hour and minute hands driven by the second motor, wherein following the first activation of the control member, the second hand is positioned on a first marking carried by the dial indicating that said first and second indicators are displaying the date, wherein following the second activation of the control member, the second hand is positioned on a second marking carried by the dial indicating that said first and second indicators are displaying the number of the month, and wherein following the third activation of the control member, the second hand is positioned on a third marking carried by the dial indicating that said first and second indicators are displaying the last two figures of the year.

3. A watch according to claim 2, wherein the control member is a stem capped with a crown able to be rotated in a first or second direction, to be pushed in from a first neutral position for which the watch is in a normal mode displaying the second, minute, hour and date, into a position which remains pushed in as long as manual pressure is exerted on the crown, and to be brought from the first neutral stable position to a second stable pulled out position then to a third stable pulled out position.

4. A watch according to claim 3, wherein the minute and hour hands are set to the correct time by pulling out said crown into the third position, then rotating said crown in one direction or the other either slowly to move the minute hand forwards or backwards, or quickly to move the minute and hour hands by one hour forwards or backwards.

5. A watch according to claim 3, wherein a first short pressure exerted on the crown causes said first and second indicators to display the date then to set said indicators to the correct date when the crown is pulled out into the second pulled out position, the date setting of said first and second indicators is achieved by rotating the crown respectively in one direction or the other, wherein a second short pressure exerted on the crown causes said first and second indicators to display the number of the month then to set said indicators to the correct month when the crown is pulled out into the second position, the month number setting of said first and second indicators being achieved by rotating the crown respectively in one direction or the other, wherein a third short pressure exerted on the crown causes said first and second indicators to display the last two figures of the year then to set said indicators to the correct year when the crown is pulled out into the second position, the year setting of said first and second indicators is achieved by rotating the crown respectively in one direction or the other, and wherein a fourth short pressure exerted on the crown brings said first and second indicators into normal mode displaying the date.

6. A watch according to claim 3, including an integrated circuit powered by a battery, this circuit being essentially formed of counters for the date, number of the month and the last two figures of the year, wherein when the battery is set in place, said counters are set to zero and wherein appropriate manipulations on the crown allow the second, minute and hour hands to be initialised at midday and the first and second indicators to be initialised to zero.

7. A watch according to claim 6, wherein when said crown is pulled out into the second position, the second hand may be initialised at midday when said crown is rotated in the first direction and the minute and hour hands may be initialised at midday when said crown is rotated in said second direction.

8. A watch according to claim 6, wherein when said crown undergoes a long pressure then is pulled out into the second position said first and second indicators may be initialised to zero when said crown is rotated respectively in the first or second direction.

9. A watch according to claim 6, wherein when said crown undergoes a long pressure then is pulled out into, the third position, said first and second indicators can be finely initialised to zero when said crown is rotated respectively in the first or second direction.

10. An electronic watch powered by an electric source, the watch comprising:

at least two hands driven respectively by first and second motors and rotating above a dial for indicating time;

a first indicator and a second indicator driven respectively by third and fourth motors, and on which are marked figures respectively a tens and a units of current data relating to the calendar, the tens and the units of the data appearing through a large aperture made in the dial; and a control member able to be activated manually to allow the time and the current data to be set, wherein the indicators are able to display in response to first, second and third activations of the control member, respectively and successively, the date, the number of the month and the last two figures of the year, and the watch is organised to cause the date to move forwards by one day at the end of months of thirty-one days, by two days at the end of months of thirty days, by three days at the end of the month of February in a leap year, and by four days at the end of the month of February in a non-leap year.

11. A watch according to claim 10, including a second hand driven by the first motor and hour and minute hands driven by the second motor, wherein following the first activation of the control member, the second hand is positioned on a first marking carried by the dial indicating that said first and second indicators are displaying the date, wherein following the second activation of the control member, the second hand is positioned on a second marking carried by the dial indicating that said first and second indicators are displaying the number of the month, and wherein following the third activation of the control member, the second hand is positioned on a third marking carried by the dial indicating that said first and second indicators are displaying the last two figures of the year.

12. A watch according to claim 11, wherein the control member is a stem capped with a crown able to be rotated in a first or second direction, to be pushed in from a first neutral position for which the watch is in a normal mode displaying the second, minute, hour and date, into a position which remains pushed in as long as manual pressure is exerted on the crown, and to be brought from the first neutral stable position to a second stable pulled out position then to a third stable pulled out position.

13. A watch according to claim 12, wherein the minute and hour hands are set to the correct time by pulling out said crown into the third position, then rotating said crown in one direction or the other either slowly to move the minute hand forwards or backwards, or quickly to move the minute and hour hands by one hour forwards or backwards.

14. A watch according to claim 12, wherein a first short pressure exerted on the crown causes said first and second indicators to display the date then to set said indicators to the correct date when the crown is pulled out into the second pulled out position, the date setting of said first and second indicators is achieved by rotating the crown respectively in one direction or the other, wherein a second short pressure exerted on the crown causes said first and second indicators to display the number of the month then to set said indicators to the correct month when the crown is pulled out into the second position, the month number setting of said first and second indicators being achieved by rotating the crown respectively in one direction or the other, wherein a third short pressure exerted on the crown causes said first and second indicators to display the last two figures of the year then to set said indicators to the correct year when the crown is pulled out into the second position, the year setting of said first and second indicators is achieved by rotating the crown respectively in one direction or the other, and wherein a fourth short pressure exerted on the crown brings said first and second indicators into normal mode displaying the date.

15. A watch according to claim 12, including an integrated circuit powered by a battery, this circuit being essentially formed of counters for the date, number of the month and the last two figures of the year, wherein when the battery is set in plane, said counters are set to zero and wherein appropriate manipulations on the crown allow the second, minute and hour hands to be initialised at midday and the first and second indicators to be initialised to zero.

16. A watch according to claim 15, wherein when said crown is pulled out into the second position, the second hand may be initialised at midday when said crown is rotated in the first direction and the minute and hour hands may be initialised at midday when said crown is rotated in said second direction.

17. A watch according to claim 15, wherein when said crown undergoes a long pressure then is pulled out into the second position, said first and second indicators may be initialised to zero when said crown is rotated respectively in the first or second direction.

18. A watch according to claim 15, wherein when said crown undergoes a long pressure then is pulled out into the third position, said first and second indicators can be finely initialised to zero when said crown is rotated respectively in the first or second direction.

* * * * *